US005876185A

United States Patent [19]

Schimpf et al.

[11] Patent Number: 5,876,185

[45] Date of Patent: Mar. 2, 1999

[54] LOAD SENSING PUMP CONTROL FOR A VARIABLE DISPLACEMENT PUMP

[75] Inventors: James E. Schimpf; Tony L. Marcott, both of Plainfield, Ill.

[73] Assignee: Caterpillar Inc., Peoria, Ill.

[21] Appl. No.: 752,507

[22] Filed: Nov. 20, 1996

[51] Int. Cl.[6] ..... F04B 49/08

[52] U.S. Cl. ..... 417/213; 417/212; 60/452

[58] Field of Search ..... 417/212, 213; 60/452

[56] References Cited

U.S. PATENT DOCUMENTS

| | | | |
|---|---|---|---|
| 3,470,694 | 10/1969 | Budzich | 60/52 |
| 4,072,443 | 2/1978 | Heath | 417/218 |
| 4,203,712 | 5/1980 | Uchara | 417/218 |
| 4,292,805 | 10/1981 | Acheson | 60/450 |
| 4,527,958 | 7/1985 | Borman | 417/213 |
| 4,553,904 | 11/1985 | Ruseff et al. | 417/218 |
| 4,695,230 | 9/1987 | Taplin | 417/218 |
| 4,699,571 | 10/1987 | Bartholomaus | 417/213 |
| 5,051,631 | 9/1991 | Anderson | 310/14 |
| 5,129,229 | 7/1992 | Nakamura et al. | 60/452 |

OTHER PUBLICATIONS

Appln. No. 08/621,924, Filed Mar. 26, 1996, "Electrohydraulic Pressure Regulating Valve", Marcott, Docket No. 94–203.

*Primary Examiner*—Charles G. Freay
*Assistant Examiner*—Ehud Gartenberg
*Attorney, Agent, or Firm*—John W. Grant

[57] ABSTRACT

A variable displacement pump has a discharge passage and a displacement controller disposed to decrease pump displacement in response to an increasing pressure signal and to increase pump displacement in response to a decreasing pressure signal. A load sensing pump control for the pump includes a displacement control valve having an input port connected to the discharge passage and a signal port connected to the displacement controller. A valve spool controls communication between the input and signal ports and is biased in a direction to block the inlet port from the signal port by a spring. The spool has a differential area for exerting a force against the spool in opposition to the spring force proportional to the pump discharge pressure entering the valve through the input port. A variable force can be selectively exerted against the spool in opposition to the spring force to change the displacement of the pump.

7 Claims, 2 Drawing Sheets

LOAD SENSING PUMP CONTROL FOR A VARIABLE DISPLACEMENT PUMP

DESCRIPTION

1. Technical Field

This invention relates to a pump control for a variable displacement pump and, more particularly, to a control that combines the load sensing and pressure cutoff controls and an electrohydraulic valve into one valve.

2. Background Art

Hydraulically driven fans are sometimes used in combination with internal combustion engines to draw air through an engine radiator. Some fans are driven by a variable displacement pump having load sensing and pressure cutoff controls with the fan speed being controlled in response to sensed temperature of the engine wherein the fan speed is increased as the temperature increases and decreased as the temperature decreases. The fan speed is normally controlled by directing a fluid pressure signal to the a displacement controller of the pump through an electrohydraulic valve.

One of the problems experienced with such systems has been the stability of that type of fan speed control. Another problem has been the cost of the system since high precision electrohydraulic valves are normally required in an attempt to improve stability.

The present invention is directed to overcoming one or more of the problems set forth above.

DISCLOSURE OF THE INVENTION

In one aspect of the present invention, a load sensing pump control is provided for a variable displacement pump having a discharge passage and a displacement controller disposed to decrease pump displacement in response to an increasing pressure signal and to increase pump displacement in response to a decreasing pressure signal. The pump control includes a displacement control valve having an input port connected to the discharge passage, a signal port connected to the displacement controller, a valve spool disposed to control communication between the input and signal ports, a spring biasing the spool in a direction to block the inlet port from the signal port, and a first device for exerting a force against the spool in opposition to the spring force proportional to the pump discharge pressure. A second device is provided for selectably exerting a variable force against the spool in opposition to the spring force.

BEST MODE FOR CARRYING OUT THE INVENTION

Figure 1:
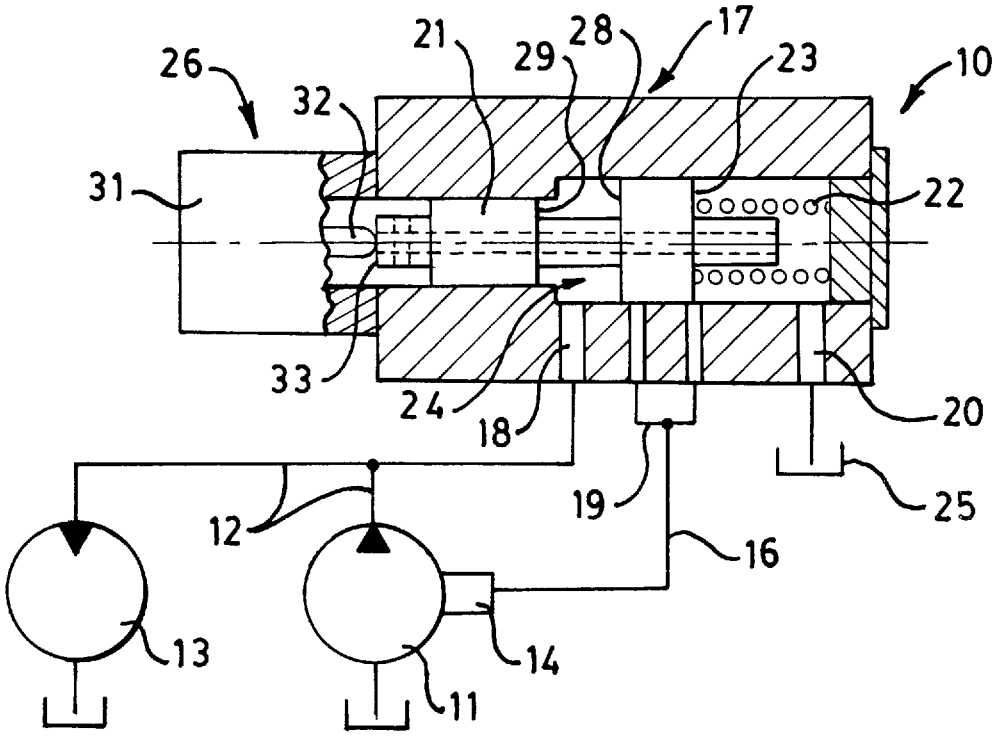
FIGS. 1, 2 and 3 are schematic illustrations of three alternate embodiments of the present invention.

FIG. 1 discloses a load sensing pump control 10 in combination with a variable displacement hydraulic pump 11 having a discharge passage 12 connected to a hydraulic motor 13, and a displacement controller 14 disposed to decrease pump displacement in response to an increasing pressure control signal received through a signal line 16 and to increase pump displacement in response to a decreasing pressure control signal in the signal line.

The pump control includes a displacement control valve 17 having an input port 18 connected to the discharge passage 12, a signal port 19 connected to the displacement controller 14 through the signal line 16, a drain passage 20 connected to a tank 25, a valve spool 21 disposed to control communication between the input, signal and drain ports 18–20, a spring 22 disposed at an end 23 of the valve spool for biasing the valve spool in a direction to block the inlet port from the outlet port, and a fluid generated force means 24 for exerting a force against the spool in opposition to the spring force proportional to the pump discharge pressure.

The pump control 10 also includes a means 26 for selectably exerting a variable force against the valve spool 21 in opposition to the biasing force exerted by the spring 22.

The fluid generated force means 24 in this embodiment includes first and second opposed annular surfaces 28,29 provided on the valve spool 21 with both annular surfaces being subjected to discharge pressure entering the valve through the input port 18. The first annular surface 28 has a larger effective area than the area of the second annular surface 29 establishes a differential area subjected to the discharge pressure so that a net fluid generated force acts on the valve spool in opposition to the spring force and proportional to the discharge pressure.

The variable force exerting means 26 includes a proportional solenoid 31 disposed to exert a force against the spool proportional to a electrical signal directed thereto. The proportional solenoid 31 includes a pin 32 disposed to engage an end 33 of the valve spool 21.

Figure 2:
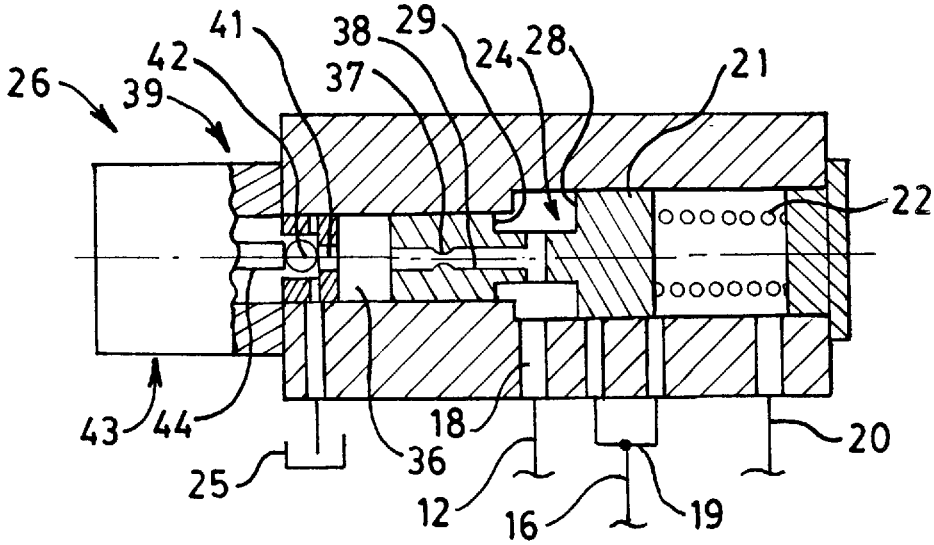

In the embodiment of FIG. 2, the variable force exerting means 26 includes a control chamber 36 defined at the end 33 of the valve spool 21, a fixed size orifice 37 communicating the input port 18 with the control chamber 36, and a proportional valve 38 disposed to control flow out of the control chamber 36. The orifice 37 is formed in a passage 39 defined in the valve spool. The proportional valve 39 includes an outlet passage 41 communicating with the control chamber 36, a valving element such as a ball 42, and a proportional solenoid 43 having a pin 44 disposed to urge the ball into sealing engagement with the outlet passage with a force proportional to an electrical signal directed to the proportional solenoid.

Figure 3:
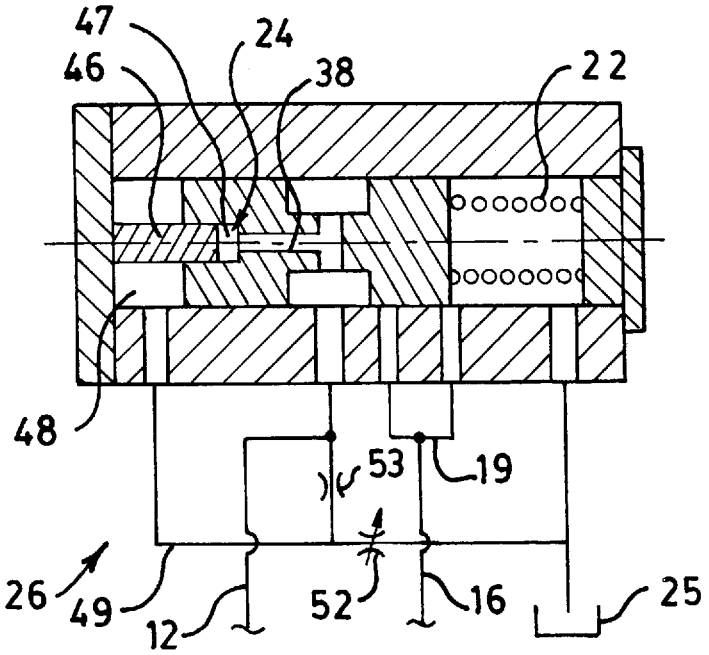

In the FIG. 3 embodiment, the fluid generated force means 24 includes a piston 46 extending into a bore 47 defined in the end 33 of the valve spool and in communication with the inlet port 18 through the passage 38. The variable force exerting means 26 includes an annular control chamber 48 circumscribing the piston 46, a passage 49 communicating the annular control chamber 48 with the tank 25, a variable restrictor 52 disposed in the passage 49, and a fixed orifice 53 communicating the discharge passage 12 with the passage 49 between the variable restrictor 52 and the annular control chamber 48.

INDUSTRIAL APPLICABILITY

The displacement controller 14 is responsive to the pressure level of a control pressure in the control port 19 and increases the displacement of the variable displacement pump 11 when the pressure level of the control signal decreases and decreases the displacement of the pump when the pressure level of the control signal increases. The valve spool 21 of the displacement control valve 17 is shown at a default position that it would occupy when the proportional solenoid 31 is de-energized and the pump 11 is not being driven.

The control port 19 communicates with the drain passage 20 at the default position resulting in the variable displacement pump 11 being at its maximum displacement position. Thus, fluid flow is transmitted through the discharge passage to the motor 13 and the displacement control valve 17 immediately upon startup of the power source that drives the variable displacement pump. This starts to drive the motor 13 with the pressure in the discharge passage 12 increasing commensurate with the load on the motor. As the discharge pressure increases, the valve spool 21 moves to the right against the bias of the spring 22 to direct an increasing pressure control signal through the signal line 16 to the displacement controller 14 reducing the pump displacement. When the discharge pressure reaches a predetermined level determined by the force of the spring, the opposing forces acting on the valve spool equalize and movement of the valve spool stops so that the displacement of the pump is held to maintain the discharge pressure at the predetermined level.

Any fluctuation in the discharge pressure will cause the valve spool to shift to change the displacement of the variable displacement pump to reestablish the predetermined pressure level. For example, if the discharge pressure decreases, the valve spool will shift leftward to decrease the level of the control signal causing the displacement controller to increase the displacement of the pump until the predetermined level of discharge pressure is regained. Conversely, an increase in the discharge pressure causes the displacement of the pump to decrease to maintain the predetermined pressure level.

The displacement of the variable displacement pump 11 can be manually decreased by directing an electrical signal to energize the proportional solenoid 31. This causes the pin 32 to exert a force against the spool opposing the bias force of the spring so that less discharge pressure is required to equalize the forces acting on the valve spool. This results in increasing the pressure level of the control signal directed to the displacement controller 14 causing the pump displacement to decrease to a setting commensurate with the strength of the electrical signal directed to the proportional solenoid. Conversely, once the displacement of the variable displacement pump 11 has been decreased by directing an electrical signal to the proportional solenoid 31, the displacement of the variable displacement pump can be increased by decreasing the strength of the electrical signal to decrease the force exerted on the valve spool by the pin 32.

The embodiment of FIG. 2 functions similarly to that described above except that manually controlling the position of the valve spool 21 is accomplished by controlling the pressure level in the control chamber 36. More specifically, with the proportional solenoid 43 de-energized, the control chamber 36 is vented to the tank resulting in little or no pressure being generated in the control chamber 36. However, directing an electrical signal to the proportional solenoid 43 causes the pin 44 to move the ball 42 rightward to restrict fluid flow through the passage 41 thereby increasing the pressure in the control chamber. Such pressure in the control chamber generates a force acting on the valve spool 21 opposing the bias of the spring 22 so that less discharge pressure is required to equalize the force on the valve spool. As noted above, this results in increasing the pressure level of the control signal directed to the displacement controller 14 causing the pump displacement to decrease to a setting commensurate with the strength of the electrical signal to the proportional solenoid 43.

Referring now to the FIG. 3 embodiment, the discharge pressure entering the displacement control valve 17 passes through the passage 38 into the chamber 47. This causes a force to be exerted on the valve spool 21 opposing the biasing force of the spring 22. As noted above, when the discharge pressure reaches a level determined by the force of the spring and the opposing forces acting on the spool equalize, movement of the valve spool stops so that the displacement of the pump is held at a position commensurate with the discharge pressure. In this embodiment, manual control of the position of the valve spool 21 is accomplished by controlling the variable restriction 52. When the variable restriction 52 is wide open, no pressure is generated in the control chamber 48. However, closing the variable restriction 52 to reduce fluid flow through the passage 49 increases the pressure in the control chamber 48. Such pressure in the control chamber generates a force acting on the valve spool opposing the spring so that less discharge pressure is required to equalize the forces acting on the valve spool. This results in increasing the pressure level of the control signal directed to the displacement controller causing the pump displacement to decrease to a setting commensurate with the size of the variable restriction 52.

Other aspects, objects and advantages of this invention can be obtained from a study of the drawings, the disclosure and the appended claims.

We claim:

1. A load sensing pump control for a variable displacement pump having a discharge passage and a displacement controller disposed to decrease pump displacement in response to an increasing pressure signal and to increase pump displacement in response to a decreasing pressure signal comprising:

a displacement control valve having an input port connected to the discharge passage, a signal port connected to the displacement controller, a valve spool disposed to control communication between the input and control ports, a spring biasing the valve spool in a direction to block the inlet port from the signal port, and first means for exerting a force against the spool in opposition to the spring force and proportional to the pump discharge pressure; and second means for selectively exerting a variable force against the spool in opposition to the spring force.

2. The load sensing pump control of claim 1 wherein the first means includes first and second opposed annular surfaces on the valve spool subjected to discharge pressure with the first annular surface having a larger effective area than the second annular surface.

3. The load sensing pump control of claim 2 wherein the second means includes a proportional solenoid disposed to exert a force against the valve spool proportional to an electrical signal directed thereto.

4. The load sensing pump control of claim 2 wherein the second means includes a control chamber disposed at one end of the valve spool, a fixed size orifice communicating the input port with the chamber, and a proportional valve disposed to control flow out of the control chamber.

5. The load sensing pump control of claim 4 wherein the proportional valve includes an outlet passage opening into the control chamber, a valve element, and a proportional solenoid disposed to urge the valve element in a direction to restrict fluid flow through the outlet passage.

6. The load sensing pump control of claim 1 wherein the second means includes a control chamber disposed at one end of the spool, a fixed size orifice disposed between the input port and the control chamber, and a variable orifice disposed to restrict fluid flow out of the control chamber.

7. The load sensing pump control of claim 6 wherein the first means includes a bore disposed in the one end of the spool and opening into the chamber, a piston slidably disposed in the bore, and a passage disposed in the spool communicating the input port with the bore.

* * * * *